US006792735B2

(12) United States Patent
Mohlenhoff

(10) Patent No.: US 6,792,735 B2
(45) Date of Patent: Sep. 21, 2004

(54) ADVANCED PROCESSES FOR CORING AND GROUTING MASONRY

(76) Inventor: William Mohlenhoff, 17951 Prado Cir., Villa Park, CA (US) 92861

( * ) Notice: Subject to any disclaimer, the term of this patent is extended or adjusted under 35 U.S.C. 154(b) by 0 days.

(21) Appl. No.: 10/092,979

(22) Filed: Mar. 8, 2002

(65) Prior Publication Data

US 2003/0167728 A1 Sep. 11, 2003

(51) Int. Cl.[7] ..... E04B 1/04

(52) U.S. Cl. ..... 52/742.16; 52/742.14; 175/11; 175/213; 175/333; 408/59; 408/204

(58) Field of Search ..... 52/742.14, 742.16, 52/574, 514.5; 405/264, 266; 175/11, 71, 212, 213, 215, 333, 404; 408/56–57, 59, 67, 68, 204, 206

(56) References Cited

U.S. PATENT DOCUMENTS 5,497,841 A * 3/1996 Cox et al. ..... 175/11

* cited by examiner

*Primary Examiner*—Carl. D. Friedman
*Assistant Examiner*—Yvonne M. Horton
(74) *Attorney, Agent, or Firm*—Morland C. Fischer

(57) ABSTRACT

Advanced masonry coring systems for coring and grouting masonry walls are disclosed in this patent. The systems include rotating machinery and a drill column in the form of a cylindrical double-piped string of pipe sections, rotating a cylindrical drill body. The drill body mounts cutting end faces having alternative means of employing carbide or diamond cutting and/or pulverizing elements. The double drill pipe weight is made workable through new aerospace composite fabrication. The double pipe permits more efficient routing of air and removal of drill cuttings. Advancement in various system components and means of placing reinforcement into walls is disclosed. Further disclosure is included of advanced means of optimizing resin grouting materials and procedures to fill the wall cavities created by the core drill, integrating the reinforcement into the walls.

21 Claims, 6 Drawing Sheets

Figure 2:
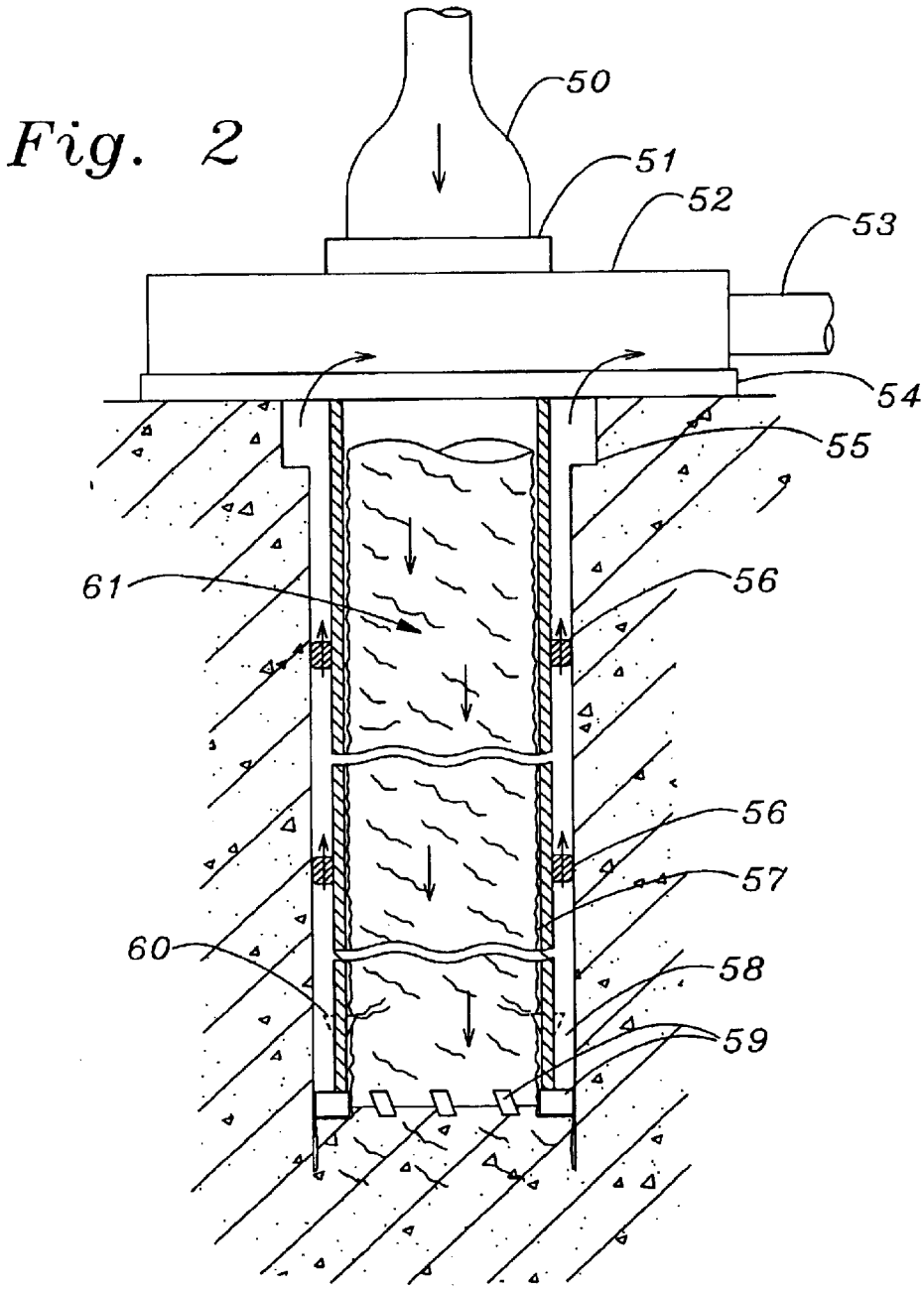

Fig. 1A
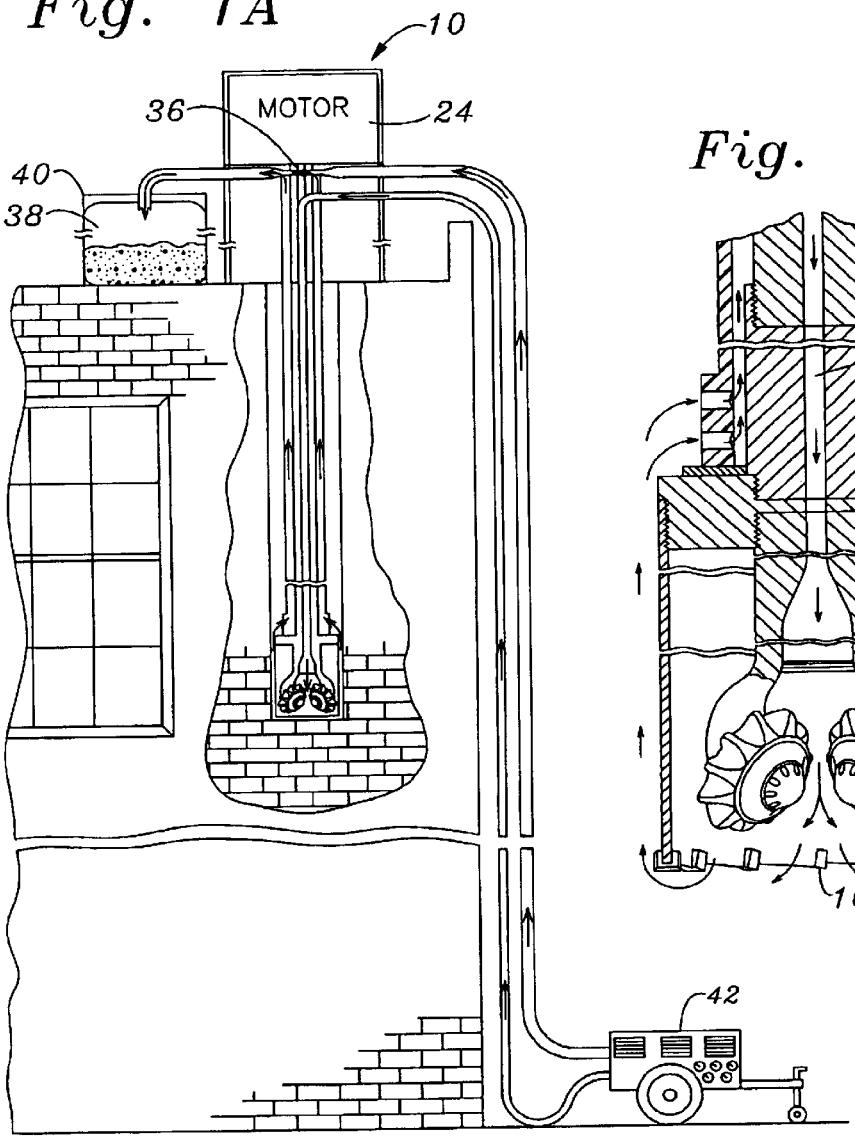
Fig. 1B
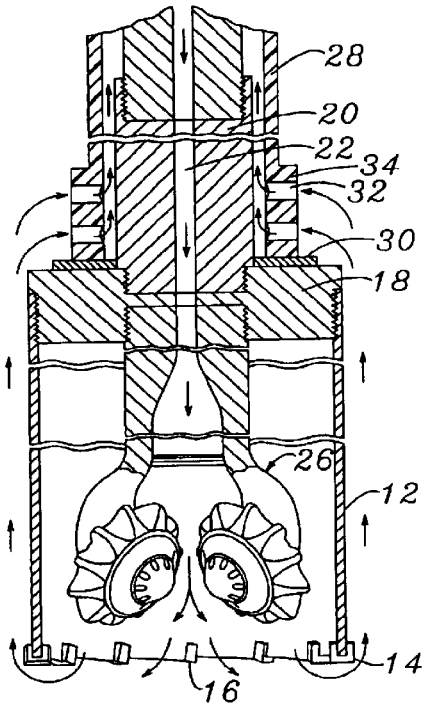
Fig. 1C
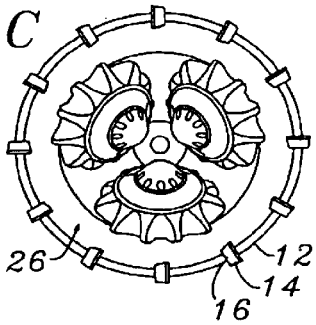
Fig. 1
PATENT 5.497,841
PRIOR ART

PATENT 5,497,841
ALTERNATE PRIOR ART

PULVERIZER OPTION

PLENUM ON DRILL ASSEMBLY WITH PULVERIZER

PIPE DESIGN

ADVANCED PROCESSES FOR CORING AND GROUTING MASONRY

BACKGROUND OF THE INVENTION

1. Field of the Invention

This invention is addressed to the processes of structural retrofit of masonry buildings, including masonry of all types and degrees of hardness and consistency, from adobe or other earthen construction to the hard granites, basalts and concretes.

2. Description of Prior Art

The optimization of the Air Extraction core-drilling system design for the processes of structural retrofit use is much different from that of well-drilling or geological systems for open drilling in ground or rock strata. Construction wet drilling of short cores in concrete had been developed from these sources. However, dry, or near-dry drilling of longer cores is essential in many structures and highly desirable in nearly all buildings needing reinforcement. Accuracy and wall protection are emphasized in construction structural applications. Cost is of paramount importance. Removal of cuttings is generally more difficult and critical. Encounters with steel are frequent.

The present patent is a result of further development of the air extraction drilling system and resin grouting technology which were proven to first order in the hardware example of method U.S. Pat. No. 5,497,841 by the same inventor, working with another inventor. The U.S. Pat. No. 5,497,841 patent was entitled "Methods For Coring A Masonry Wall", FIG. 1. The specialized technology to accomplish core placement in a larger percentage of structures, expanding its use and efficiency, is the subject of this follow-on patent.

The entire field of structural retrofit through coring of masonry walls, placing reinforcing elements into the cores and filling the cores with a strong adhesive grout, bonding the reinforcement into the structure, has been referred to by engineers as the "Center-Core Method".

The solvent-based resinous grouts are also an important and indispensable part of the Center Core technology. They are substantially better than cementious bonding adhesives which require wetting of surfaces with water for adequate bonding. There is a considerable quality-control problem with water-based and cementious materials in regard to this wetting requirement, especially as to uniform optimal wetting. Also, even the strongest cementious adhesives require additives and plasticizers for good retrofit bonding. The stronger mixtures of cementious grouting materials also are not liquid enough; i.e., do not have low enough viscosity to fill all the small cracks and voids left by masons in the original construction. Further, the water in water-based grouting materials is the solvent, but it does not carry the adhesive well into cracks and voids to form a network of bonding.

Properly-selected resinous grouts, on the other hand, permit use of excess low viscosity resin over that needed to saturate the grouting sand, which will therefore fill all accessible small cracks and voids, fully integrating the structure wherever the resin can run or be drawn through gravity and capillary action. The excess resin will always rapidly migrate through several feet or more of wall, even through and into the smallest cracks, dependent on the formulations and the procedural techniques used in the installation of the grout. The larger voids are readily filled with the resin-sand grouting mixture through gravity pressure. The grout can also be pumped, under pressure.

The setting resins, properly formulated, are substantially superior to cementious grouts in regard to adhesive strength and in the ability to integrate the steel and masonry, to absorb shock and deformation. The grout ductility and impact resistance may readily be adjusted through formulation variables. Thus, the dry core-drilling system, steel or other reinforcement insertion procedures and associated resin grouting system form an optimal retrofit combination. University testing has shown that this combination usually will increase the wall strength to a much greater level, as much as several times that of the wet-drilling and cementious grouting combination. It is usually stronger than the equivalent original reinforcement applied in new construction to current building codes, depending on the size and spacing of the cores.

The structural engineer should evaluate the number of cracks and voids in the wall as well as the mortar strength and other reinforcement parameters, comparing the structural retrofit being designed with that of test data and earthquake experience available for this specialized Center-Core technology. This comparison data was derived in university and National Science Foundation test reports and an actual earthquake, with the assistance of the inventor. The correlation of this data will allow the capable engineer to empirically select the proper core size and spacing for out-of-plane flexural loading or in-plane shear loading and other design details, as local government codes require.

Confirmation of the specialized Center-Core method as embodied in the earlier patent was established in the responses of the Center-Core retrofitted walls of six buildings within 12 to 20 miles of the earthquake epicenter in Northridge, Los Angeles, Calif., Jan. 17, 1994. This was a Richter 7 level earthquake. None of these Center-Cored buildings sustained even structural cracking in Center-Cored areas, while buildings around them cracked badly and structural failures with cracking and even partial collapses were common among masonry buildings in the same area. Many of the buildings around those with Center Core had received some strengthening measures, but without any type of wall strengthening.

The Center Core method applies to all masonry materials, but it is optimized more for the softer materials which are more common, worldwide, such as brick, soft sandstone and limestone, adobe, terra cotta and the like. It is less optimal, but still substantially preferable in most under-reinforced harder materials such as concrete, concrete block, or rock, including granite and basalt building materials. It has been applied in all such buildings; over 80 buildings have successfully received the method. Over 50 of these buildings were retrofitted by this inventor team with no quality control problems, whatsoever. Most of the remainder were almost certainly by U.S. Pat. No. 5,497,841 patent infringers. A few were by concrete wet drilling companies who had many problems in schedule delays, cost overruns and job failures.

The method also allows cutting of steel, including reinforcement, pipes, framing, hangers, lintels and the like, included in masonry structures and often not noted in original or present building plans, specifications and drawings.

In harder materials, use of water or other liquids in a mist as a coolant, or as coolant foams are often more efficient because of the superior cooling properties of these media, especially with the use of diamond bits. If possible, the water or foam is injected to just humidify and cool the air, but allow it to dry and keep the cuttings from caking after passing through the hot bit assembly.

The method of the basic patent in the air extraction of cuttings is employed insofar as possible in much the same way as with softer materials. Bits for harder materials usually have diamond cutting elements, while softer materials most often may be drilled with carbide elements. In all structural core-drilling applications it is highly desirable, and most often mandatory, to avoid employing water under high pressure to prevent mortar damage, masonry unit loosening and blowout, and water stains in exteriors and interiors. However, a limited use of coolants, usually water, in the Center Core air extraction method of the former patent in harder materials, as a mist or vapor in the air, or foam, can be advantageous.

The improvements and innovations herein patented are designed to illustrate and characterize, but not exhaustively record all usable configurations of the better novel hardware methods and system solutions for structural core drilling and resin grouting. The hardware applicability is primarily addressed to historically important structures in a world-wide employment of the methods patented in this and the previous method U.S. Pat. No. 5,497,841. The Center Core method is herein optimized further with novel innovations for expanded use.

The historical structures may be designed with enough cores to prevent structural cracking. However, all masonry buildings in seismically hazardous areas should use the method. For adequate public safety, the less historically or architecturally significant buildings can economically be retrofitted with fewer cores just to prevent building collapse. Center Core, applied in optimal ways, as in this patent, therefore may be widely used to save the lives being lost to earthquakes from failures of any masonry material, even in adobe or small earthen block structures. It applies cost-effectively to nearly all under-reinforced masonry, (URM), structures, constructed around the world.

The present patent also is addressed to the physical specifications for resinous grouting of the cores in optimal ways in all types of masonry. These procedures and materials also include quality control provisions, ensuring that cores will completely perform their functions. The entire Air Extraction Center-Core method or process is centered around the capability and capacity of the air extraction system which cools the bits and extracts the core-drilled cuttings. The complete method also is keyed to the strong, low viscosity resin-grouting system. Most importantly, integrated design of the entire system and employment procedures must be accomplished for optimally cost-effective operations.

Single-pipe Core Catcher Subsystem. As an example of the previously patented method, the inventors have inherently included an off-the-shelf hardware method termed the core-catcher subsystem, also called the core-lifter subsystem, FIG. 2. Various manufacturers have provided spring-loaded devices 60 to remove the inner portion of the core in solid, unpulverized form via a set of spring devices which catch and grasp pieces of the core at the bottom end and allow the operator to lift the entire column of the solid cored material with the drill string as it is withdrawn from the core. The spring-loaded devices are designed to allow the drill string always to be forced downward to cut more core, but snap into the solid-cored material, most often at a break point or mortar joint in the masonry core, to catch the material for withdrawal. Various techniques are used to break the solid core, if necessary.

The advantages of the core-catcher are that it can be employed to reduce the amount of material pulverized or ground up by the core drill 61, FIG. 2, and therefore it reduces the torque required for turning the drill column. It also reduces the amount of material that must be handled in dust and particles by the air stream and vacuum system, FIG. 1, thereby reducing the demand on the entire air extraction subsystem. The combination of all these advantages usually permits faster, less expensive core-drilling. However, to make room for the core catcher, wider kerf drill teeth FIG. 2, 59 must be employed. These wider kerf teeth remove a greater amount of material at the outer periphery of the core. The drill cuttings are then extracted outside of the single pipe 58, using the core-walls themselves as the second "pipe" to extract the dust-laden air. At the wall entry point, a plenum catches the material and directs it via a tube to a large vacuum, and into a container as in the nominal U.S. Pat. No. 5,497,841 patent embodiment FIG. 1. The other features of the FIG. 2 core-catcher variation of the FIG. 1 patent, 50–57, are also included in the present patent, discussed below.

A wide kerf bit disadvantage is that the drill column is free to wander more. As the column becomes longer in deeper drilling, the torque required is greater and may tend to twist the column and cause it to wander off-center. Hard materials and voids encountered in the masonry also cause drill misalignment. Greater precision is required in the threaded ends of the pipe sections. To help resist torque wander and misalignment, off-the-shelf "reamer" sections 56, used in geological applications to ream cores to larger size, may be adapted for use as bearing sections for the drill column. With the stiffness of the off-the-shelf drill pipe and deeper cores, reamers have often been required for accurate, controlled drilling. The reamer sections must have open spaces or spokes to allow the dirt-laden air to pass through them in the FIG. 2 prior art system.

The single-pipe, with double passage, using the core walls, and sometimes with an auxilliary plastic pipe to route the cuttings upward, is covered adequately under the method U.S. Pat. No. 5,497,841. An additional patent was not considered essential to illustrate variations of hardware used to carry out the method in this manner. However, in the present double-piped, triple passage patent, off-the-shelf hardware is not available to adapt to the method and, also, novel new hardware innovations are required to facilitate the new system features discussed below. Almost all components of the system must be redesigned for optimal drilling performance and increased capability. The key design details will be discussed below, though small innovations are also needed.

OBJECTS AND ADVANTAGES OF THE SUBJECT INVENTION

Limitations Of The Earlier System Configurations And Need For The Present Patent Innovations. The characteristic hardware configuration of the U.S. Pat. No. 5,497,841 patent, the full-core pulverizer as shown by the tri-cone example, is optimal only in a limited number of cases. While it would accomplish the core-drilling adequately in brick masonry walls up to 35 ft in depth or more, it was inherently less accurate than partial pulverization alternatives offered in the core-catcher approach. The core-catcher also drilled at a faster rate and was less costly in drill-bit wear and replacement. When 6 inch diameter cores were drilled, the tri-cone bit or any full pulverization bit became limited by the air extraction system in drilling rate and dust control because of the volume flow of dust-laden air required to achieve cost-effective drilling rate performance. The amount of dust became difficult to handle.

To meet the more demanding structural strengthening needs, the traditional construction design alternatives tend to be selected. These conventional methods include cementious gunite or shotcrete, poured-in-place panels or buttresses for wall-strengthening, or steel-framing to attach steel to existing masonry structure. These alternatives have been undesirable in historical retrofit projects where they would alter the architecture, but they could sometimes be selected for other buildings where historical preservation was not a significant factor. Only rarely were the alternative methods less expensive, but they are the traditional methods and would sometimes be substituted for the more cost-effective and architecture-preserving Center Core methods by conservative engineering firms.

While substantially more efficacious and cost-effective in most masonry structures, the Center Core method must be promoted to engineers. Full optimization of the equipment and procedures has been required to compete well with the traditional, less effective, less desirable structural retrofit methods. The ability to use the method efficiently in a large variety of structures was essential to its acceptance as a preferred retrofit method.

Another factor discouraging use of the complete pulverization system is the greater torque required to turn the drill column, especially at greater core diameters, limiting depth and rate of drilling.

Drilling rates directly determine cost of the drilling and low rates may even prohibit use of the method in less valuable structures. In addition, the pulverizer could not often pulverize steel, encountered frequently and unexpectedly in many Center Core projects. The steel could often be cut with the core cutting bit but could not be removed readily enough because it requires withdrawing the drill column. This "tripping out" to install and use steel cutters, then again to remove the steel, is a serious delay and cost factor in many core-drilling jobs.

These limitations of the full pulverizing hardware approach to dry core drilling were improved with the core-catcher approach to the method of the previous patent. Core catchers and reamer sections were available off the shelf and were adapted to the system for improvements in equipment cost, torque reduction, drilling rate, depth of cores to be accommodated, handling and column weight, a significant problem especially in greater diameters and lengths, and steel encounters.

The complexity of the plastic pipe riding on the drill body assembly was an additional complication and labor generator in the total pulverization system of the previous patent.

The previously patented system in the core-catcher variant also has other limitations. It is still difficult to adequately control the volume rate of dust generated from otherwise satisfactory drilling rates. With the core-catcher, the wide kerf bit is also not a good steel cutter, especially with the less costly carbide bit teeth. If the steel cannot be cut with the bit in use, an extra trip out and in to change the bit is added to the trip out and in to remove the steel from the bit.

The reamer sections usually required with the core-catcher are a small added labor factor. Even with them, it is still difficult to achieve desired accuracy. However, with care and increased drilling time, accuracy can be as good as one-tenth degree, about one inch in 50 ft of depth for cores to 30 or 40 ft of Depth. Core depths approaching 100 ft require excessively slow drilling rates, measured in lineal inches per minute, and add significantly to cost per lineal foot. Greater depths result in reduced accuracy and increased cost per lineal foot of drilling. The drilling is labor intensive and labor cost is therefore by far the greatest cost factor.

The U.S. Pat. No. 5,497,841 patent of FIGS. 1 and 2 thus encompassed the various means of employing a single pipe or shaft and auxilliary-piped, double-annulus core drilling systems. The systems were partially assembled from drilling hardware developed for, and utilized in geological or well-drilling applications; however, they were adapted as novel departures and modified from the configurations used in previous applications, with some fabrication of components specifically for the Center Core application.

The present invention could not be considered a further characterization of the U.S. Pat. No. 5,497,841 method or process system hardware. Hardware innovations of this patent are a substantial departure from adaptation of hardware used in geological, mining or well drilling operations. The present new designs have even greater specificity to the masonry building retrofit field and will significantly improve the hardware employed in present structural retrofit operations. There are many design details in the new designs which could only be envisioned from the experience with the previously patented systems. However, most important in these innovations is the proposed adaptation of aerospace fabrication methods, a departure from previous core-drilling hardware fabrication.

The above discussed limitations of the pulverizer and single-piped core-catcher approach are not totally prohibitive and will suffice in drilling rate performance for the softer masonry, lesser core depths, lesser core diameters, lesser accuracy requirements and infrequently encountered steel or other hard materials embedded in the structure. However, successful, but limited application of the FIGS. 1 and 2 pulverizer and core catcher systems has led to a realistic need for extended, less limiting hardware characteristics. The alternative system which is less limiting in these respects is that of the integral "Double-Piped, Triple-Passage System" of this patent.

The pulverizing tri-cone or other pulverizer of the entire core was shown with a plastic pipe connected around the drill shaft riding on the drill body in U.S. Pat. No. 5,497,841, FIG. 1. The drill shaft had a hole through it's length wherein the high pressure air was introduced to cool the bit assembly and entrain the drilling dust. But the entire core was pressurized at the relatively high pressure needed to move all of the material of the core upward with enough energy and far enough to be withdrawn by the vacuum at the drill entry point, FIG. 1. The speed of drilling, in lineal inches per minute, often became extraction-limited.

The pressure and energy to move the cuttings back up to the wall-entry point was substantially reduced by the obstruction and friction caused by the need to pass the air through the pulverizing inner bit. There was a great deal of leakage to atmosphere with higher core diameters and drilling rates. The plenum at the top, (or entry point if not drilling vertically), could be a source of air pollution which could coat all areas around the core with dust, if the vacuum plenum design is not carefully worked out and vacuum is not strictly maintained.

BRIEF SUMMARY OF THE INVENTION

The full double-piped drilling system was always a possible solution to gain greater capability, including more depth, higher drilling rates and greater accuracy. But, it was initially rejected because of its somewhat greater complexity, cost and weight. As the pulverizer and single-pipe core-catcher were used in some fifty California, South Carolina and Utah projects, the limitations as to depth, drilling rate and accuracy, steel cutting, etc, were more and more obvious.

Finally, with the use of aerospace composite fabrication technology, the presently-proposed, alternative double-concentric column, triple-passage configured system was considered both practical and essential. The new technology permits a system design that deals with complexity, cost and weight adequately. The double-pipe drill system permits much greater depth, accuracy, drilling rates and reduced costs of drilling at reasonable hardware costs. The resulting design approach is the subject of this patent.

BRIEF DESCRIPTION OF DRAWINGS AND TABLES

FIGS. 1A, 1B and 1C are diagrammatical drawings from U.S. Pat. No. 5,497,841, included as a reference to recall the principles of the previous method patent.

FIG. 2 then illustrates the Core-Catcher variation of the U.S. Pat. No. 5,497,841 invention to differentiate it from the prior art and the present innovations.

Figure 3:
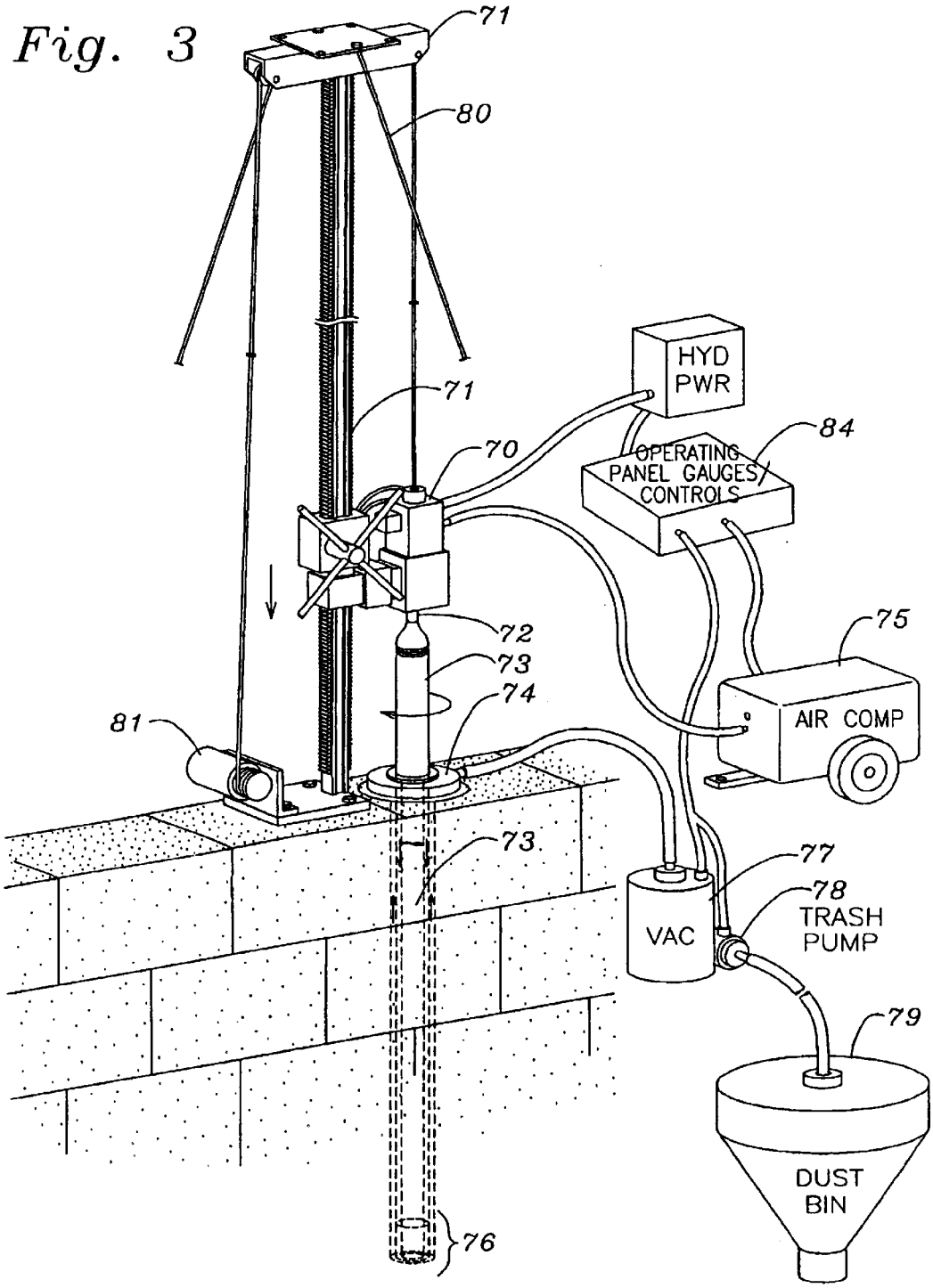

FIG. 3 is an overall schematic view of the present invention, showing the double-piped configuration diagrammatically, depicting the entire core-drilling system.

Figure 4B:
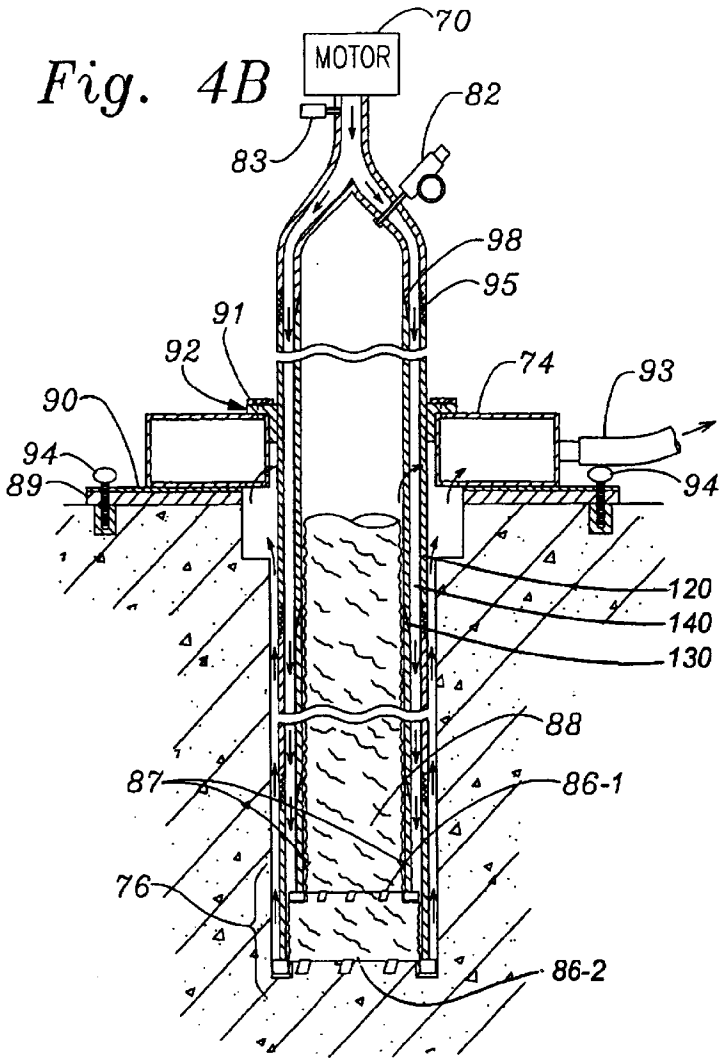
Figure 4A:
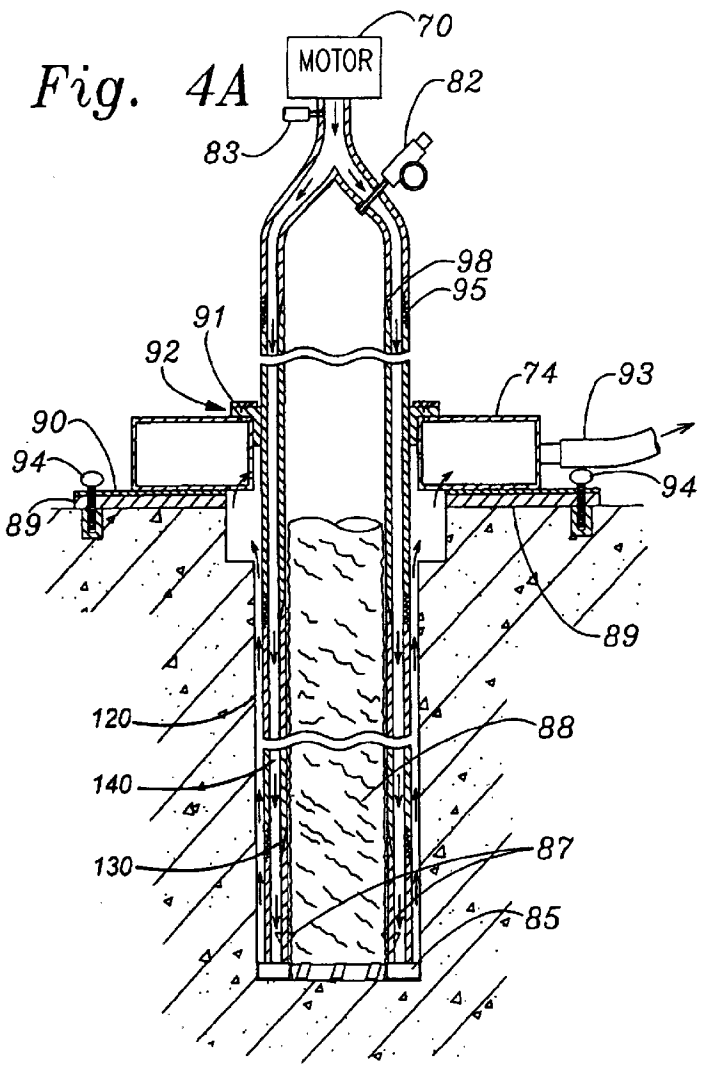

FIG. 4 further diagrammatically details the plenum, top of the double-piped drill column and airflow for the double-piped Core-Catcher design, as the presently preferred approach. FIG. 4A shows the mounting of the single array of drill teeth at the drill cutting face on both pipes, while FIG. 4B shows the alternate narrower-kerf, configuration of teeth mounted in staggered concentric arrays on both outer and inner pipes.

Figure 5:
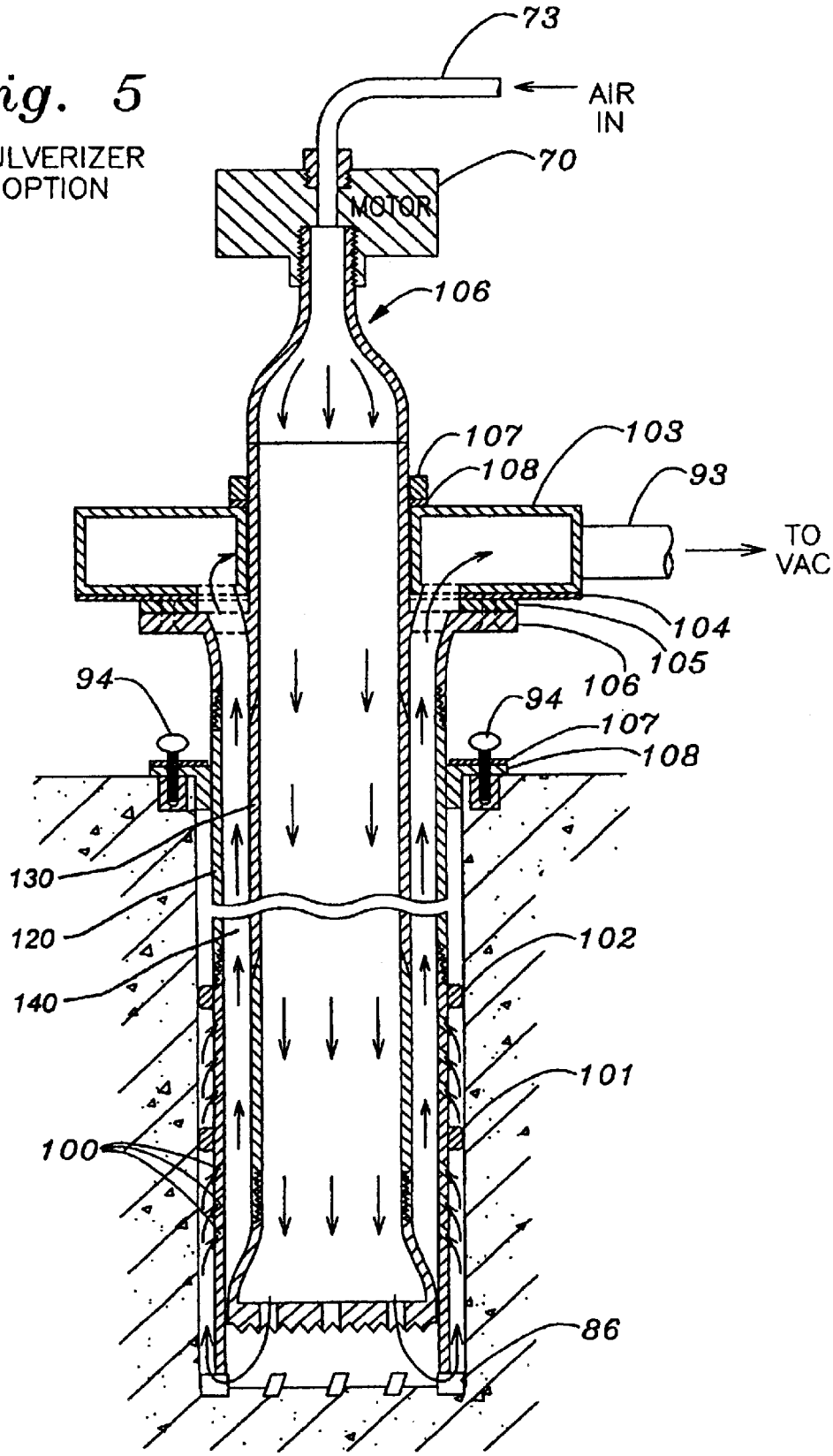

FIG. 5 further diagrams the plenum, drill body, airflow and drill teeth for the double-piped pulverizer system. The specific geometric configuration of the drill cutting and pulverizing elements is best left to the drill body manufacturer and the drilling foreman.

Figure 6B:
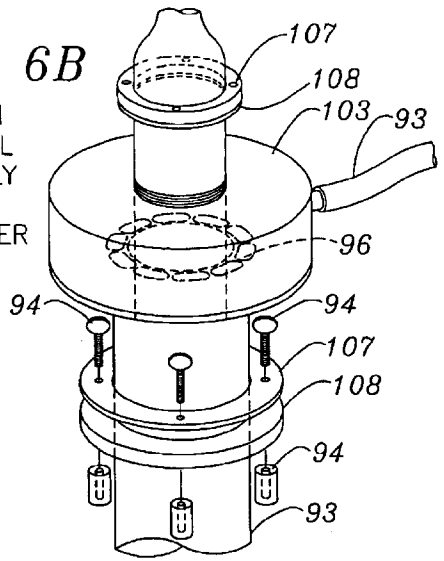
Figure 6A:
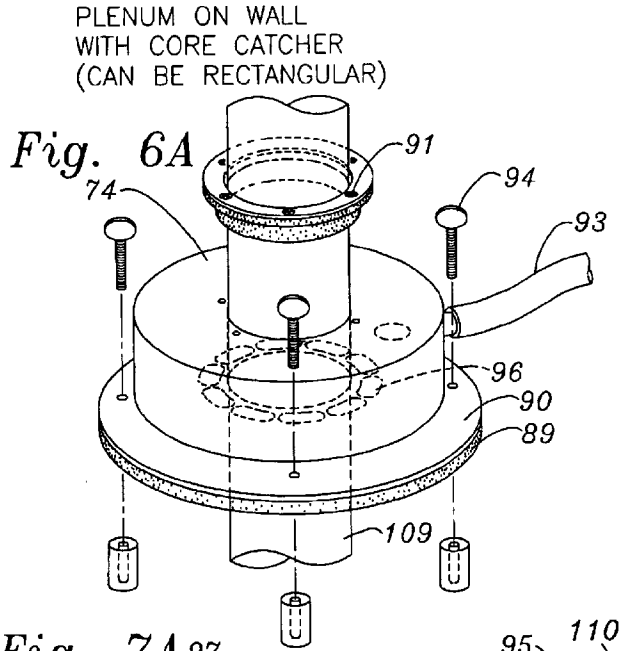

FIG. 6 then diagrams the plenum configuration in perspective view for the Core-catcher in FIG. 6A and the Pulverizer in FIG. 6B.

FIG. 7 illustrates the probable configuration of the double-pipe attachment system, showing a metallic end fitting and connection between pipes, with a schematic thread configuration. The favored means of bonding composite pipe material to the metal is also shown schematically.

Table 1 below summarizes the resin characteristics which meet the system requirements.

Table 2 is a summary of the pre-patent, former patent and subject patent configuration descriptions for ready reference.

SUMMARY OF THE INVENTION AND EXPLANATION OF THE DRAWINGS

Core Catcher System. In the present nominal integral and concentric double piped system design using the core-catcher option, FIG. 3, the air is introduced through the drill motor 70, mounted on a drill stand 71. The motor is remotely powered with hydraulic or pneumatic power. The drill motor is mounted on a roller-carnage assembly 71, attached to the building wall as before, in FIGs. 1 and 2. At the turning shaft of the drill-head 72, the double-pipe 73 is attached via an adapter for the diameter of the pipe. The integrated double-pipe turns inside the vacuum air plenum 74, with the outer and inner drill-pipe 120 and 130 forming an annulus 140 through which a large, remotely-located compressor 75 forces high pressure air, via a passage through the drill motor 70. The outer pipe string is attached with open-spaced, aerodynamically-shaped spacers to the inner pipe string 99, FIG. 7.

The air is reversed at the drill bit 76, FIG. 3, where it also cools the bit elements 85 and 86, FIG. 4. The air has sufficient pressure, with vacuum augmentation at the wall-top, to permit returning dust-laden air from the drill bit 76 to reach the plenum 74 and then enter the vacuum container 77.

Thus, in this nominal core-catcher embodiment, the pipes 73 carry the high pressure air down the drill column outer passage to the cutting bits, then the annulus 140 between the core wall and outer pipe 120 carries the dirt-laden flow back upward to the vacuum in the plenum 74, where it is drawn off into the vacuum container 77. A dust collecting bin 79 may be continuously fed by a "trash pump" 78 from the vacuum container, or the container must frequently be emptied, requiring more labor cost.

The annulus 140 between the pipes 120 and 130 delivers air at high pressure, limited as necessary by the wall masonry pressure capacity, to the drill bit assembly 76, FIG. 3 and 85, 86-1 and 86-2, FIGS. 4A and 4B. The first function there is to cool the cutting bits with a direct flow of air. Thus, the bit assembly must be designed to route air directly through or past the bit elements.

If a wall leak develops because of the high pressure and wall weakness or cracks at the outer bit, it is observed as a dust puff and is marked for tuck-pointing or caulking. This is important for the grouting to be accomplished to fill the core, wherein leakage must be prevented. These dust puffs also allow the operator to determine the pressure limits of the masonry. He may therefore operate at the highest pressure possible and caulk the wall, if too constrained.

The airflow through the bits then has the dual function of cooling the bits and entraining the cutting dust, carrying it away from the cutting elements. The bit assembly design must reverse the downward velocity of the clean air to the upward, slower velocity of the dust-laden air. In shorter cores, the airflow may actually entrain small chunks of the cored material, but at greater depth; the finer material will flow upward readily and the rest will tumble and be ground into finer material. Greater depths will require slower drilling rates. Drilling rate is adjusted as turning rate of the column and downward pressure or weight on the column.

It should be remarked that the operator must properly note drill parameters and control several variables. He controls the motor RPM and torque via design and control of the remote hydraulic, pneumatic or integral motor-driven drill head, (FIGS. 3 and 4 ). He controls the maximum pressure and volumetric flow of air at the drill-head (p, CFM), via compressor selection 75 and regularity control. He can reduce pressure if there are too many puffs of dust at the drill bit or increase it for higher material flow, allowing greater drilling rates. He controls downward force on the drill bit assembly. If the inner pipe 130 chokes up with core debris and dust, or the bit elements become clogged and drilling rate is reduced or halted, he may lift the bit assembly and allow the airflow to flush out the clogged material. He can also even reverse the airflow with a valve designated to remove clogs, 82, FIG. 4, with the rotation stopped and measurement of air pressure in the inner pipe column to assist. The required relief valve and desirable pressure gauge can be installed by tapping off the inner pipe 130 through the outer pipe 120 above the solid core material 88.

The operator can control liquid or foam injected into the air stream at 83. He also controls the maximum vacuum system flow and negative pressure through equipment selection and settings to provide full removal of cuttings at the highest depths and drilling rates, paying attention to maintenance of the vacuum seals at the plenum for maximum efficiency. A suitable control panel, with indicators and controls should be developed for convenient control of these critical parameters 84, FIG. 3.

The solid core not pulverized by the bit system will be removed by the core-catcher/lifters 87 as in the system of FIG. 2 (60 in FIG. 2). In the present double-piped system, however, the high pressure air stream is not passed down through spaces around the debris of the solid core, which can clog up and inhibit the incoming airflow; but instead, passes between the pipes. This design provision avoids blockage of the primary airflow and prevents interference with the air extraction subsystem, which was a serious problem in the single-piped core-catching system.

The bit assembly is fitted with either diamond or carbide elements, dependent on whether the structure is of harder or softer materials. The bit assembly sometimes employed will be that of the FIG. 4A wide kerf bit, mounted on both pipes 85. If steel is to be encountered and cut, the bit elements can be optimized to cut the steel and the bit assembly can be magnetized to hold it for withdrawal.

The steel-cutting bit can also preferably have a narrower kerf, to cut the steel more efficiently than in the FIGS. 1 and 2 systems if the inner and outer pipes are in staggered array and are both fitted with narrower steel-cutting elements, FIG. 4B, 86.

The core catcher assembly FIG. 4A, 87 in this inner double-pipe functions in the same way as that of the previous patent, FIG. 2, 60. However, the solid portion of the cored material 88 is allowed to more freely fill the inner pipe and then be withdrawn with the drill string. No air is forced down through this cored material as in the FIG. 2 system of the previous patent.

With a core-catcher installed in the inner pipe bit assembly, reamer sections 56, FIG. 2 should not be needed at the pipe interconnecting points in the double-piped system. These reamer rings will not be needed as much for torque-twisting and bending as with the single pipe system and may not be needed at all. They would not be used unless necessary because they would partially restrict airflow and create pipe section attachment complexity and drilling time. If used, the rings can be designed to be replaced when worn. The width of the bit kerf, FIG. 4, can be tolerable in the double-piped system because the core-catcher spring devices will be contained within the air annulus between pipes.

The core-catcher plenum 74, FIGS. 3 and 4, should be fitted with suitable resilient gaskets and retaining rings; 89,90,91,92 against the masonry wall and inside the plenum "donut-hole", pressing against the diameter of the outer pipes, to prevent loss of vacuum. The gasket around the rotating pipe 92 must have low friction and/or lubrication and act as a sealed bearing to allow the fixed plenum to retain its vacuum integrity. The gasket between the plenum and the wall 89 retained by a plate with holes into the plenum must be of a spongy but resilient material, to seal irregularities in the wall surface and take repeated usage. The gaskets must be easily and quickly replaceable, at low cost. The plenum itself must be designed for quick attachment and removal.

The plenum configuration with the core-catcher 74 is mounted on the wall as shown in FIG. 4A and 4B. Seals at 90 and 91 are retained by suitable rings which have adjustments to permit the operator to control the friction, but prevent vacuum leakage. The vacuum line 93 is attached to the plenum, 74. The detail of the Plenum for the core catcher double-piped system is seen in FIG. 6A. The plenum can be held down with simple hand-tightened wing-bolts 94 set into anchors drilled into the wall, FIGS. 4A and 4B.

The airflow must be confined to pass directly through the bits for adequate cooling; 85 and 86, FIGS. 4A and 4B. Alternative design details are also feasible and these details are only examples of appropriate design concepts which any competent fabricator or operator can supply. Auxilliary provisions, described below, augment these advanced concepts further.

Both FIGS. 4A and 4B configurations can be fitted with a core catcher. But, FIG. 4B is the better design, in that it will allow the steel to be cut by the outer bit and caught or cut further by the inner bit. The bit elements can then be optimized better for the steel encounters.

Pulverizing Bit Assembly And System. A pulverizer, with a rotating or even a rotating, pulsating action may be used advantageously for rapid drilling in permissible conditions, FIG. 5. Either of these pulverizer options may be installed inside and above a core-cutting bit 86. Air passages 100 direct the air and entrained cuttings back into the outer passage between the pipes. A reamer/bearing ring is included where needed to first allow the air to flow 101 and then stop the air from flowing 102 up the outer passage. These rings also may help to keep the drill string from misaligning due to bending, as needed.

The plenum 74 in the pulverizer system is fixed by a bracket to the drill motor assembly 70 and the pipe column is allowed to rotate through a combination bearing and seal 104/105 at the plenum base. The motor connection is adapted to the drill pipe in use by an adapter 106, a part of the air-expanding bell pipe attached to the motor and mounted on the drill motor assembly 70, FIG. 3 as detailed in FIG. 6 B. The different air-flow bell from the core-catcher system is to provide for the needed change in air/dust routing. Seals are then also needed at the wall around the drill string and at the top of the plenum 108. These seals need adjustment rings at 107/108 for wear to keep them airtight for the vacuum air. Steel may then be encountered and cut with the core-cutting bit elements on the face of the outer pipe 120, without tripping out just to change bits. Steel encounters will, however, many times require tripping out to remove the steel after it is cut. Magnetizing the inner bit assembly helps to lift the steel fragments out of the core.

Both the plenum 103 and the drill motor adapter bellpipe 106 must be designed for the drill pipe diameter to be used.

Drill pipe Configuration. The drill pipe configuration for both the Core-Catcher and the Pulverizer can be constructed in the same or closely similar manner. A compromise to allow the same double pipes to be used for both systems is possible. There is very little air pollution potential with the Pulverizer configuration because the high air pressure is mostly contained within the inner pipe. The maximum pressure applied to the wall is at the drill bit, reduced by friction in the drill-piping and bit assembly. However, loss of vacuum air will reduce efficiency and limit the depth or rate of drilling. Nevertheless, the Core-Catcher may be able to operate at lower pressures because the air pressure is directly applied and will entrain less dust.

As to the weight, complexity and cost, the double-piped configuration is much stronger, geometrically, and the material can be fabricated of aluminum, other light alloy or of aerospace composites for advantages which compensate for weight and cost. The inner and outer pipes 120 and 130 are connected with suitable aerodynamically designed connecting attachment lug configurations to permit air passage with low friction. The inner pipe 130 may have a close, tapered fit, while the outer pipe 120 carries the coarse, but precisely cut threads. Thread precision and lubrication are required for installation and to prevent drill column flexural bending.

Figure 7B:
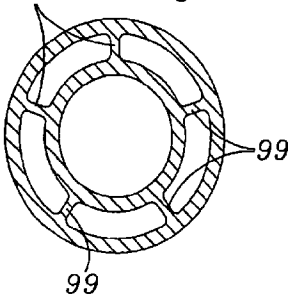
Figure 7A:
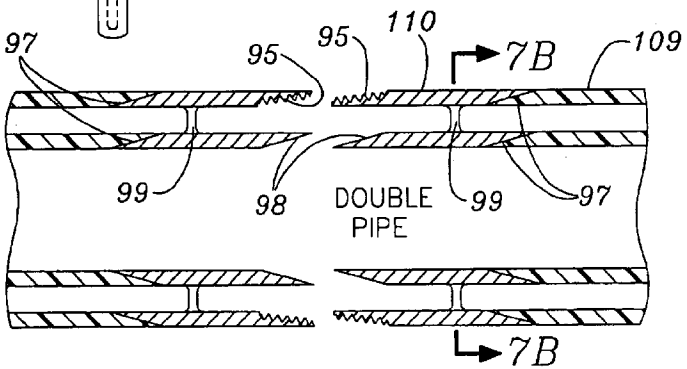

A promising detail of the pipe connections and air passages beginning in FIG. 4A/B at the pipe/motor adapter bell pipe thread connections 95 or at 106 in FIG. 5 is seen in more detail in FIG. 7A and 7B. The composite or lightweight metallic pipe may be attached to a metallic or other suitable end assembly at 97 and mated by fit at 98. The end assembly will integrate the concentric pipes via lugs 99 between the pipes. The lugs are aerodynamically-shaped. Other design details are also feasible.

Aerospace Composite Fabrication. The drill pipe sections 109, FIG. 7 should eventually be filament-wound of graphite or similar high strength fibers, or laid up around a mandrel with resin prepreg material, using epoxy or a similar high strength bonding matrix in the graphite fiber or fabric. This construction method is used for aircraft structure, boat masts, bicycle frames, etc, and recently for automobile drive shafts. The drive shafts bond the composite material onto aluminum or steel fittings for attachment in the drive trains of automobiles.

The double-piped system can have the additionally claimed innovation of convenient double-pipe integration through airflow-shaped integral spacers in the metal fittings at the pipe-ends 99. While this fabrication approach may be more expensive initially, the overall cost, including labor, can be reduced because of the light weight and high strength of such materials. Filament-winding of the composite materials will also further reduce the cost.

Greater diameters and/or longer pipe lengths can be accommodated with composite construction because of reduced weight. The double-piped system is only practical with the lighter materials. Therefore, this patented system is not as feasible without the lightweight composite materials. A 5-foot double steel pipe can weigh well over 100 pounds, depending on the diameters. These weights are prohibitively more than can be tolerated in Center Core operations. Center Core operations are carried out mostly on the parapets of walls, where only hand lifting of drill pipe is practical. However, an equivalent double graphite pipe with metal-threaded end fittings integrating the pipes can weigh a tolerable 25–40 pounds. The graphite also will have greater strength and stiffness, reducing torque twist and possibly eliminating the need for reamer sections and their attachment time. Drilling accuracy will also be a fall-out benefit. This fabrication approach is at the heart of the double-piped patent claims.

The technology of filament-winding or mandrel-wrapping to fabricate two pipes singly for integration in concentric dimensions is well established. The technology of bonding these pipes to metallic end units is also established, particularly in the fabrication of automobile drive shafts. However, the added innovation of bonding a dual metallic fitting to the pipes in a way that will permit the objects of this patent have not been developed previously. The resulting operation of strings of up to a hundred feet or more of lightweight drilling column will thereby be feasible. This is not an obvious extension of existing technology and the development should widen the basic technologies of the fields of fabrication involved.

Long Mast Lifting/Hoisting Provisions. U.S. Pat. No. 5,497,841 method hardware initially employed an off-the-shelf short drill mast and roller carriage assembly. The shorter mast could not be aligned and secured well to facilitate initial accuracy-critical alignment. The initial alignment of the drill string in the first section of 4–5 ft pipe and drill body must be precisely set to very close tolerances, to within as little as one-tenth of one degree. A longer drill stand and roller carriage allows the critical alignment task to be performed more accurately and retained more securely.

A longer drill mast and winch, capable of hoisting a drill string of many pipe lengths, also can provide for various hoisting requirements. Occasionally, the entire drill column might need to be lifted to clear debris choking and clogging the bit assembly. The winch on the mast can also be helpful in clearing a bit assembly which becomes frozen through steel or other hard materials embedded in the wall or inadvertent forcing and over-torquing of the drill bit.

After trial, it has been confirmed that the long drill mast stand and roller carriage assembly 71 FIG. 3 is capable of being set more accurately by attaching struts and cables 80 to the hoisting top of the long mast, where they interfere less with the drilling equipment and procedures. These provisions hold alignment better. The base end of the drill stand is also secured to building structure. The mast is fitted with a cable hoist 81 FIG. 3 which allows up to 2 sections of pipe to be lifted above the wall entry point. The hoist can be used to lift the column when hand operation of the roller carriage manual wheel is difficult due to the column weight. The roller carriage design is now to include a dual track and rollers, made of the hardest possible wearing metals, replacing single track masts of present systems, to improve alignment accuracy.

Although the size and weight of the longer drill mast and roller carriage is more cumbersome to move into position, these and other advantages speed up the operation and increase accuracy in deeper cores. The drill stand mast should also be fabricated of composite materials. This is a worthwhile auxiliary hardware subsystem, improved with these features.

Pneumatic Pulsating Impact Drill Bits. When there is no steel in the wall and the material of the wall is hard concrete or stone, fired masonry units or the like, greater drilling rates can be achieved with pulsating impact bits. While there are considerations which would preclude use of these bits, there are some projects which will permit their use and they will have significant advantages in drilling rate, multiplying rates of drilling by several times, given that the cuttings can be removed rapidly enough. The limitations are as follows:

(1) These bits make substantial noise, like small jackhammers, and the project must be cleared for such noise over the duration of the drilling schedule.

(2) The pulsating bit may loosen wall mortar. If the mortar is loosening too extensively, such that it will not be bonded in by the resin grout, these bits may have to be excluded from use.

(3) These bits may cause spalling at rock or concrete block unit exit points, or cracking of the unit. If too many units are being damaged unacceptably to the building owners, architects and engineers, the bits may have to be excluded. These bits are almost always excluded for softer and weaker masonry unit construction, where drilling rates are otherwise satisfactory.

For the foregoing reasons, the pulsating impact bit should be optimized for construction retrofit employment by increasing the rate of pulsation to the maximum, while decreasing the force of the impact to just that which will dislodge particles from the surface of the core. Adjustment must be provided for variations in cored materials. Some rotation is also needed to re-orient the bit to the core surface as it separates particles in the core surface.

Liquid Coolant Provisions For Hard Masonry Or Concrete. Use of some water or liquid should speed drilling rate and reduce bit wear. The bits for hard masonry are usually fabricated with poly-crystalline diamond elements, mounted in a suitable matrix. While water may be used to advantage in hard materials, or actually must be used for some very hard materials, it should never flood the core under pressure and cause caking and plugging of the core voids and/or leakage from cracks. Most of all and to the extent possible, the water and cuttings should not be removed through holes made into the masonry, which could spoil it's appearance and/or cause intolerable clean-up problems. Instead, only enough water to cool the bit should be used, but the system should allow air extraction of water and cuttings in the same manner as for dry core-drilling, if possible.

Thus, a water mist or coolant foam injection attachment should be piped into the air lines for these hard masonry applications. Compressors to generate the airflow can possibly bypass their water separators. The water mist flow should be set to allow drying out the dirt in the air as the turbulence is encountered in the bit area. This critical setting requires fine vernier control of the liquid/foam injection rate.

Greater air pressure down the pipe annulus and maximum vacuum draw up the outside annulus, (core-catcher system), should permit greater drilling depths and core diameters in harder materials, without water damage and exit holes marring interiors and exteriors. If moisture remains in the walls after drilling, the walls must be dried completely, cleaned with stiff metal scrubbing brushes, and vacuumed thoroughly for resin grouting.

Steel Placement and Tensioning. Almost all Center-Core operations utilize threaded steel rebar in the 0.5 to 1.5 inch diameter sizes. Graphite or other materials may be superior in some installations, at greater expense. The threaded rebar allows simplified coupling for greater core depths where single-piece rebar lengths are too cumbersome to handle. Plastic "baskets", or "centralizers" are fabricated, usually from PVC pipe, to hold the steel to the center of the core.

The use of threaded rebar allows the rebar to be tensioned after pouring about 1–3 feet of resin grout at the bottom of the core, which will provide a good anchor to achieve very high tension. With tests of only 6 inches of resin embedment, the resin held the tension to yield strength of the steel. At the top of the core, a plate is placed over the steel. The plate should be strong enough to avoid any deformation and large enough to spread the load on the wall masonry. The steel is held to the tension pulled on a calibrated hydraulic unit by a securing or holding nut and locking nut on top of the plate. A hole in the plate allows the resin grout to be filled to the plate. The compression in the wall is usually spread over the wall area through a bond or chord beam atop the parapet and adequate, preferably reinforced foundations at the bottom of the wall.

Resin Grouting . The resin grouting procedure was initially tested by California State University, Long Beach, (CSULB), under National Science Foundation grants and was also developed in parallel by this inventor's company. CSULB proved that the polyester resins were the best choice to mix with sand and employ as a bonding medium integrating the steel with the wall masonry. These resins were proven to be substantially superior to cementious materials for the reasons heretofore given. They are also superior to epoxies when filled with grouting aggregates. Furthermore, they are much less expensive than epoxies.

The University showed experimentally that a high-strength, medium viscosity setting resin grout was several times superior to cementious grout as to the in-plane and out-of-plane force resistance which opposes simulated earthquake forces. The inventor's company had previously developed a related grout, but one which achieves substantially higher strengths at much lower viscosities, working with consultants and polyester resin suppliers.

CSULB did not attempt to optimize the resin formulation or the procedures for its use. While the formulation is not necessarily patentable, the proper choice of resins as to physical characteristics is of utmost importance in the superiority of the Center-Core method over competing means of preventing collapse of masonry structures through structural retrofit. The resin grout must have optimal characteristics in the following order of importance:

(1) High adhesive bonding strength to steel and masonry, with easy and simple quality control to achieve it in field operations.

(2) Low viscosity, to permit the resin to readily penetrate all cracks and voids in the masonry, repairing any cracks from previous earthquakes, winds, floods and deterioration.

(3) High material impact resistance.

(4) Reliable, high material strength properties.

(5) Adequate properties such as shrinkage, elongation, heat and fire resistance, resistance to moisture penetration, hardness and durability over time. Setting Resins are impervious to water when cured, which makes them highly preferable to cementious materials where water penetration and steel corrosion can be a problem.

These characteristics trade off to some extent, but certain branches of the polyester family are preferred and further modified in combining and optimizing the grouting materials. For instance, the Long Beach State experiments were made mostly with orthopthalic polyesters. The inventor and suppliers have improved the viscosity by a factor of 1 to 4 over these experimental resins. The selected branch of polyester resins, with some formulation adjustment, has bettered the experimental resins by about 40% in the strength characteristics. In fact, the selected resins, mixed with sand, are better than epoxies tested by CSULB. Although the epoxies of the CSULB tests were somewhat better than the CSULB polyesters in adhesive and material strength, they were more viscous; in fact, too viscous. The inventor's polyester selections are much stronger and much lower in viscosity than the CSULB resins. In fact, the inventor's resin selection is stronger than epoxies even in the anchoring of the drill stand to masonry walls.

TABLE 1 is a summary of specified resin characteristics which meet the strict requirements of this patent. ASTM test results for resins tested by CalState Long Beach, (CSULB), and for resins developed and improved by the inventors are shown. The importance of low viscosity is that the resin quantity is selected to exceed saturation of the sand by about ten percent; the excess resin is then free to run into cracks and is drawn along deep, narrow cracks through capillary action and gravity pressure. The resin has been found in subsequent cores at great distances from a filled core. This network of resin in cracks and voids integrates the wall in a substantial "pillar effect" around the steel and creates a large "pillar" of integrated masonry extending away from the steel. The migrating distance is dependent on the wall internal configuration, which should be evaluated by the structural engineer.

The particular resin formulations can vary slightly with manufacturer batch, weather, sand strength and gradation of sands, but none of these factors are as important as moisture effects in sand or cores, which must be completely dry for optimal results with the Center Core grouting. All of these quality control factors are easily managed.

In addition to specifics of formulation to achieve the Table 1 listed characteristics, various handling, mixing and pouring procedures are important to the achievement of optimal results. Weather factors must be controlled, but are not severe. The grouting should be accomplished at ambient temperature levels above 50 degrees F. and without precipitation.

The resin installation methods are much easier to carry out successfully than the equivalent methodology of the cementious, water-based grouting materials. While grouting sand gradation is not critical, it should contain some fines and should be very dry. Resin grouting is substantially superior to cementious grouting in that the cementious materials require optimal wetting of the core for full strength such that timing of the pour is critical. It is literally impossible to optimize the curing of the cementious adhesives in the core, because gravity causes excess water at the bottom of the core and dryness at the top, depending on the timing of the grout pouring. Moreover, the strongest formulated cementious materials have much less adhesive strength than the polyester resins formulated by the inventors through companies supplying the bulk resin materials.

Further Objects And Advantages Of This Invention: Earthquake Performance. Tests at Calstate Long Beach and the University of California, Irvine by the University, engineers and the inventor company showed that the above-described pillar effect extends out at least some two feet in the wall from a 4 inch core, diminishing with distance from the core, allowing typical placements at about every 4 feet for stringent earthquake codes. The 4-inch core typically multiplied the in-plane shear strength of the wall by a factor of not less than 3.3 in the University of California, Irvine structural laboratory testing, wherein the worst possible installation conditions were tested. Six-inch cores yield a factor of at least 6 in these conditions and may be spaced further apart. Spacing should theoretically be limited to three-quarters of the height between building horizontal diaphragms, (floors and roof structures).

University tests were confirmed in an actual earthquake. Six buildings in which Center Cores had been installed were subjected to the Richter 7 level Northridge earthquake within 12–20 miles. No cracks were found in any of the cored areas despite severe cracking and some wall collapses seen in adjacent area buildings of otherwise similar construction. Thus, a full scale, dynamic empirical test has been made of this technology and its application to building retrofit construction, on a worldwide basis. Center Core has now been successfully applied, though much less optimally than this patent system will allow, over a period of some 14 years to some 80 buildings, through structural materials from adobe to granite and basalt.

Therefore, in the hands of qualified appliers and logistics suppliers, this technology is fully proven and should be utilized wherever earthquakes, wind damage and deterioration require retrofit to be carried out. With a few weeks of training, any experienced and capable drilling and grouting crew and experienced building inspector can be taught the methods and applications of this system. Unfortunately, however, there have been construction companies which attempted to apply the methods without adequate training and/or without the U.S. Pat. No. 5,497,841 patent system innovations, who did not fully succeed in completing some of the projects. The inventors were called in and were able to complete the projects in some cases. In others, the project was redesigned to eliminate the core-drilling approach, but with compromise to the architecture of the structures, compromises with seismic safety and, invariably, higher cost.

Though preferential embodiment of the integral double-piped system is herein shown, there are other embodiments which could accomplish the basic system objectives, given this general pipe configuration. Aerospace composite fabrication can also be utilized beneficially in the fabrication of single-piped drilling systems, but the double-piped system is the technology that will permit optimal dry core-drilling in the majority of masonry buildings seen around the world.

It is certain that the present patent represents a substantial improvement in the capability to carry out vitally needed, life-protecting Center Core operations, worldwide. It is planned that this patent specification will provide structural engineers with an expanded capability, sufficient to justify full worldwide expansion of the application of the system to many of the under-reinforced buildings in zones where buildings are collapsing in earthquakes and taking the lives of the occupants.

Hurricane and tornado-level winds are also damaging structures in many areas of the world. Buildings designed and built in the areas where engineering codes have not been applied or before they were applied, need the Center Core technology. The technology can be tailored to the level of protection affordable and needed and will therefore always be cost-effective. Moreover, it can be applied even in times of recession or depression, because it will provide needed jobs, while substantially enhancing public safety.

Table 1 below is the resin specification table. Table 2 is a summary comparison of the pre-patent and previous patent technology with that of the present patent.

TABLE 1

Resin Physical Specifications

| Characteristic | ASTM | CalState Long Beach | Inventor Specs* |
|---|---|---|---|
| Maximum Viscosity, Centipoise | Brookfield | 800 Cps | 150–300 Cps* |
| Minimum Tensile Strength | D-638 | 6000 psi | 9000–10,000 psi |
| Heat Distortion Temperature, 264 psi | D-648 | 140 deg F. | 185 deg F. |
| Minimum-Maximum ultimate Elongation | D-638 | 1.5%–4.5% | 2.8% |
| Minimum Elastic Tensile Modulus | | 350,000 psi | |
| Flexural Modulus | D-790 | | 450,000–470,000 psi |
| Flexural Strength | D-790 | | 17,000–18,000 psi |

TABLE 1-continued

Resin Physical Specifications

| Characteristic | ASTM | CalState Long Beach | Inventor Specs* |
|---|---|---|---|
| Hardness, 934-1 Barcol | D-2583 | | 35–40 |
| Compressive Strength | D-695 | 14,000 psi | 18,000 psi |

*The inventor's resin specifications have been met but can vary with styrene vapor requirements of OSHA. The inventor resin is optimized for low water absorption and fast cure time, in addition to low viscosity and high strength. The resin grout is a mixture of these resins and selected gradations of sand, having some fines, but allowing the resin to flow out of the sand to insure crack filling. Proper control of promoter and accelerator components of the polyester resins is essential to the control of the above properties and the gel and working time, in various weather conditions.

TABLE 2

COMPARISON OF PRE-PATENT, FORMER PATENT(5,497,847) AND PRESENT TECHNOLOGIES

| (1) PROCESS/SYSTEM | (2) EQUIPMENT | (3) PLENUM |
|---|---|---|
| SINGLE-PIPE SYSTEM PRIOR TO PATENT 5,497,841 Mostly Water-Cooled | OFF-SHELF SHORT DRILL STAND AND ROLLER CARRIAGE WITH HYDRAULIC MOTOR; REMOTE HYDRAULIC PUMP | NO PLENUM, BUT IF AIR USE ATTEMPTED, REQUIRES PATENT INNOVATIONS |
| PATENT 5,497,841 | | |
| (PRIOR ART) SINGLE-PIPE WITH AUXILIARY CONCENTRIC PIPE OUTSIDE DRILL SHAFT, RIDING ON DRILL BODY. ALTERNATE SINGLE PIPE & CORE CATCHER.<br><br>THIS IS THE NEXT STEP UP IN COST FROM PRE-PATENT SYSTEM; ALLOWS FULL USE OF AIR EXTRACTION, AVOIDING USE OF WATER TO PRESERVE BUILDING ARCHITECTURE. | USES PRE-PATENT EQUIPMENT PLUS LARGE REMOTE COMPRESSOR TO SUPPLY AIR FOR BIT COOLING AND DUST REMOVAL. COMPRESSOR AIR ALSO DIRECTED TO A VENTURI VACUUM MOUNTED ON A DRUM, OR OTHER HIGH CAPACITY VACUUM TO DRAW DUST OUT OF PIPES THROUGH A PLENUM AND PREVENT LEAKAGE TO ATMOSPHERE. USES OFF THE SHELF SYSTEMS WHERE POSSIBLE TO REACH OBJECTIVES. | PATENT EXAMPLE-VACUUM PLENUM ANCHORED TO WALL, WITH DRILL SHAFT & AUXILIARY PIPE PASSING THROUGH IT AND PACKING OR SEALING OF VACUUM AIR.<br>*AIR REVERSAL REQUIRES DEVELOPING A COMPLEX PLENUM WITH SEALED BEARING FOR HIGH PRESSURE AIR, TO BE MOUNTED ON DRILL HEAD, WITH VACUUM EXIT THROUGH MOTOR. HIGH UNWARRANTED RISK. |
| NEW PATENT | | |
| INTEGRAL DOUBLE-PIPED 3-PASSAGE SYSTEM WITH LIGHTWEIGHT FABRICATION INCREASED AND OPTIMIZED AIRFLOW AND IMPROVED DRILLING COMPONENTS, YIELDING: FASTER, DEEPER, LARGER DIAMETER, MORE ACCURATE, CLEANER LESS-COSTLY DRILLING; ALSO, OPTIMIZED REINFORCEMENT AND RESIN GROUTING; ALL FOR BUILDING SAFETY AND PRESERVATION | EMPHASIS NOW SHIFTS TO GREATER CAPABILITY AND REDEVELOPMENT AS REQUIRED TO ACHIEVE AN OPTIMIZED SYSTEM AND PROCESS, APPLYING EXPERIENCE. SINGLE-PIPE SYSTEM WILL BE USED WHERE COST-EFFECTIVE BUT WILL BENEFIT FROM THE NEW TECHNOLOGY OF THIS PATENT. THE DRILL STAND AND ROLLER CARRIAGE SHOULD NOW BE REDESIGNED AND THE PLENUM INTEGRATED WITH IT; INCLUDES NEW, IMPROVED EQUIPMENT, HIGH CAPACITY VACUUM, ETC. | PLENUM HAS PASSAGE FOR DRILL PIPE ROTATING INSIDE VACUUM SEAL;<br>a. PLENUM ANCHORED TO MASONRY WALL WITH VACUUM SEAL FOR CORE CATCHER SYSTEM AND LINE TO VACUUM DRAWING OFF AIR AND DUST.<br>b. VACUUM PLENUM FOR PULVERIZER IS AFFIXED TO THE CORE DRILL HEAD AND MOTOR ASSEMBLY TO INCREASE AIRFLOW WITH THE ADDITIONAL DUST.<br>*AIRFLOW REVERSAL PROBLEM SAME AS FOR SINGLE PIPES. |

| (1) PROCESS/SYSTEM | (4) DRILL PIPE | (5) FLUID FLOW |
|---|---|---|
| SINGLE-PIPE SYSTEM PRIOR TO PATENT 5,497,841 Mostly Water-Cooled | SINGLE PIPE; STEEL CYLINDRICAL PIPE SECTIONS, THREADED TO BE JOINED TOGETHER. | WATER/AIR DOWN INNER PIPE PASSAGE; UP OUTSIDE OF PIPE, OR OUT THROUGH HOLES IN WALL |

TABLE 2-continued

COMPARISON OF PRE-PATENT, FORMER PATENT(5,497,847) AND PRESENT TECHNOLOGIES

| | | |
|---|---|---|
| PATENT 5,497,841 | | |
| (PRIOR ART) SINGLE-PIPE WITH AUXILIARY CONCENTRIC PIPE OUTSIDE DRILL SHAFT, RIDING ON DRILL BODY. ALTERNATE SINGLE PIPE & CORE CATCHER.<br><br>THIS IS THE NEXT STEP UP IN COST FROM PRE-PATENT SYSTEM; ALLOWS FULL USE OF AIR EXTRACTION, AVOIDING USE OF WATER TO PRESERVE BUILDING ARCHITECTURE. | a. EXAMPLE GIVEN IN PATENT 5,497,841. SHAFT 1.75 in. dia.; CONCENTRIC PLASTIC PIPE, RIDING ON DRILL BODY; found NON-OPTIMUM; or<br>b. STRONG STEEL. DRILL PIPE WITH CORE CATCHER; NO AUX PIPE; REAMERS PREVENT TORQUE TWIST FOR WIDE KERF BIT LEAVING WIDE GAP BETWEEN PIPE AND CORE WALL. | a. WITH FULL PULVERIZATION. AIR DOWN HOLE IN SHAFT AND AIR/DUST UP BETWEEN SHAFT AND AUX PIPE RIDING ON DRILL BODY; or<br>b. WITH CORE CATCHER, AIR OR WATER/AIR MIST OR FOAM IS ROUTED DOWN THROUGH SOLID CORE INNER PASSAGE VOIDS AND UP PASSAGE BETWEEN PIPE & CORE WALL. |
| NEW PATENT | | |
| INTEGRAL DOUBLE-PIPED 3-PASSAGE SYSTEM WITH LIGHTWEIGHT FABRICATION INCREASED AND OPTIMIZED AIRFLOW AND IMPROVED DRILLING COMPONENTS, YIELDING: FASTER, DEEPER, LARGER DIAMETER, MORE ACCURATE, CLEANER LESS-COSTLY DRILLING; ALSO, OPTIMIZED REINFORCEMENT AND RESIN GROUTING; ALL FOR BUILDING SAFETY AND PRESERVATION | DOUBLE PIPES OF LIGHTWEIGHT FABRICATION, IDEALLY OF AEROSPACE COMPOSITES AND INTEGRATED VIA LUGS IN METAL THREAD-ENDS BONDED TO COMPOSITE PIPE SECTION BODIES.<br>a. CORE-CATCHER PASSAGES FOR AIR AND DUST WILL CARRY LESS DUST THAN PULVERIZER AT SAME DRILL RATES.<br>b. COMPROMISE WILL BE NEEDED IN DESIGN OF PASSAGES FOR THESE DRILL BODY ALTERNATIVES. | AIR/FLUID COOLING AND CLEANING ARE EMPLOYED DIFFERENTLY FOR CORE CATCHER OR PULVERIZER DRILL BODIES.<br>a. CORE CATCHER HIGH PRESSURE AIR/MIST PIPED DOWN BETWEEN PIPES AND UP BETWEEN WALL AND PIPES TO VACUUM PLENUM.<br>b. PULVERIZER FLUID FLOW IS THROUGH MOTOR TO BOTH BITS FROM INNER PASSAGE AND BACK TO VACUUM PLENUM. |

| (1) PROCESS/SYSTEM | (6) DRILL BODY | (7) DRILL BITS |
|---|---|---|
| SINGLE-PIPE SYSTEM PRIOR TO PATENT 5,497,841 Mostly Water-Cooled | STEEL CYLINDER WITH THREADS FOR DRILL BIT. | CYLINDRICAL SPACED ARRAY OF CARBIDE OR DIAMOND TEETH, MOUNTED ON DRILL BODY LOWER FACE. |
| PATENT 5,497,841 | | |
| (PRIOR ART) SINGLE-PIPE WITH AUXILIARY CONCENTRIC PIPE OUTSIDE DRILL SHAFT, RIDING ON DRILL BODY. ALTERNATE SINGLE PIPE & CORE CATCHER.<br><br>THIS IS THE NEXT STEP UP IN COST FROM PRE-PATENT SYSTEM; ALLOWS FULL USE OF AIR EXTRACTION, AVOIDING USE OF WATER TO PRESERVE BUILDING ARCHITECTURE. | a. STEEL CYLINDER; CUTTING BIT ON CYLINDER FACE; INTERNAL PULVERIZING BIT INSIDE DRILL BODY; or<br>b. CORE CATCHER TO CATCH AND HOLD CORE MATERIAL FOR REMOVAL; AIRFLOW DOWN THROUGH CAVITIES IN SOLID CORE TO COOL BITS AND CARRY DIRT. WIDE KERF BITS. | a. OUTER BIT IS A NARROW KERF CORE CUTTER; INNER BIT IS PULVERIZER SUCH AS TRI-CONE OR, in some cases a PERCUSSION BIT; or,<br>b. WIDE KERF DRILL BIT TO GIVE ROOM FOR CORE CATCHER. NO PULVERIZING BIT. AIR PASSED THROUGH CORED MATERIAL REAMER SECTIONS TO MAINTAIN ALIGNMENT OF DRILL STRING. |
| NEW PATENT | | |
| INTEGRAL DOUBLE-PIPED 3-PASSAGE SYSTEM WITH LIGHTWEIGHT FABRICATION INCREASED AND OPTIMIZED AIRFLOW AND IMPROVED DRILLING COMPONENTS, YIELDING: | 4 BASIC TYPES OF DRILL BODIES ARE USED:<br>i. Wide kerf bits attached to both pipe with core catcher in inner pipe.<br>ii. Narrow kerf bits on outer pipe and wider kerf | a. CORE CATCHER BITS ARE TO CUT BOTH MASONRY AND STEEL, WITH CATCHER TO HOLD IT AND LIFT IT WITH COLUMN FOR WITHDRAWAL.<br>b. PULVERIZER BITS TO |

TABLE 2-continued

COMPARISON OF PRE-PATENT, FORMER PATENT(5,497,847) AND PRESENT TECHNOLOGIES

| | | |
|---|---|---|
| FASTER, DEEPER, LARGER DIAMETER, MORE ACCURATE, CLEANER LESS-COSTLY DRILLING; ALSO, OPTIMIZED REINFORCEMENT AND RESIN GROUTING; ALL FOR BUILDING SAFETY AND PRESERVATION | bit at higher point up drill body with core catcher above it.<br>iii. Tri-cone or other core-breaking pulverizer bit inside inner drill body pipe.<br>iv. Pulsating pulverizer inside inner drill body pipe. | CUT CORE ARE ALSO CO-OPTIMIZED FOR STEEL CUTTING AND PULVERIZING INNER BIT ASSEMBLY IS TO MAGNETICALLY HOLD STEEL FOR WITHDRAWAL WITH THE COLUMN. THE OBJECTIVES ARE TO AVOID TRIPS OUT TO MOUNT BITS FOR STEEL. |

| (1) PROCESS/SYSTEM | (8) AMPLIFYING REMARKS |
|---|---|
| SINGLE-PIPE SYSTEM PRIOR TO PATENT 5,497,841 Mostly Water-Cooled | SOLID CORE OFTEN REMOVED FROM WALL SIDES WITH CRITICAL PATCHING PROBLEMS. USE OF AIR WITHOUT PATENT IS PROHIBITIVELY SLOW FOR CONSTRUCTION SCHEDULE AND COST. WATER CAUSES DAMAGE AND GROUTING PROBLEMS. |
| PATENT 5,497,841 | |
| (PRIOR ART) SINGLE-PIPE WITH AUXILIARY CONCENTRIC PIPE OUTSIDE DRILL SHAFT, RIDING ON DRILL BODY. ALTERNATE SINGLE PIPE & CORE CATCHER.<br><br>THIS IS THE NEXT STEP UP IN COST FROM PRE-PATENT SYSTEM; ALLOWS FULL USE OF AIR EXTRACTION, AVOIDING USE OF WATER TO PRESERVE BUILDING ARCHITECTURE. | THE SINGLE-PIPE AND CORE CATCHER USUALLY GIVES FASTER DRILLING RATES IN SOFTER MATERIALS, THROUGH FULL PULVERIZATION IS OFTEN USED FOR SMALLER DIAMETER CORES, WITH LESS DEPTH. BOTH VARIATIONS REQUIRE SOME NEW FABRICATION AND SOME OFF-THE-SHELF PROCUREMENT OF EQUIPMENT DESIGNED AND OPTIMIZED FOR SHORT CONCRETE CORES OR GEOLOGICAL APPLICATIONS. SYSTEM IS ALTERED FROM THESE CONFIGURATIONS AS REQUIRED. SIX-INCH PIPES ARE TOO HEAVY AND NEED COMPOSITE FABRICATION AVAILABLE IN THE NEW PATENT. THE CORE CATCHER IS APPLIED TO BOTH NEW PATENT AND 5,497,841. PRE-PATENT EQUIPMENT SIZING AND OTHER SPECIFICATIONS ARE VARIED CONSIDERABLY, ESPECIALLY IN REGARD TO HIGH AIRFLOW VOLUME. AIRFLOW IS CRITICAL TO BOTH COOLING AND REMOVAL OF CUTTINGS. |
| NEW PATENT | |
| INTEGRAL DOUBLE-PIPED 3-PASSAGE SYSTEM WITH LIGHTWEIGHT FABRICATION INCREASED AND OPTIMIZED AIRFLOW AND IMPROVED DRILLING COMPONENTS, YIELDING: FASTER, DEEPER, LARGER DIAMETER, MORE ACCURATE, CLEANER LESS-COSTLY DRILLING; ALSO, OPTIMIZED REINFORCEMENT AND RESIN GROUTING; ALL FOR BUILDING SAFETY AND PRESERVATION | NEW PATENT REQUIRES DESIGN AND FABRICATION OF MANY COMPONENTS, BUT WILL MORE THAN PAY FOR THE DEVELOPEMENT. THE INTEGRATED, LIGHTWEIGHT DOUBLE PIPE SYSTEM PERMITS SUBSTANTIAL IMPROVEMENTS IN MASONRY CORE DRILLING & CLEANING OF THE CORE FOR OPTIMAL GROUTING. BOTH CORE CATCHER AND FULL PULVERIZING BITS HAVE THEIR OPTIMAL APPLICABILITY. STEEL CUTTING AND REMOVAL IS SIGNIFICANTLY AND SYNERGISTICALLY IMPROVED. AIR MAY BE ROUTED THROUGH THE 3 PASSAGES OF THE PIPES AND WALL, ALLOWING IMPROVED AIRFLOW MANAGEMENT. THE PIPES ARE MUCH MORE RESISTANT TO BENDING AND TWISTING, ALLOWING BETTER ALIGNMENT AND ACCURACY. DESIGN OF PIPES TO ACCOMPLISH BOTH CORE CATCHING AND PULVERIZING REQUIRES COMPROMISE IN DESIGN OF PASSAGES. NEVERTHELESS, VARIATION OF AIR-FLOW WILL COMPENSATE ADEQUATELY, TO REACH AND MAINTAIN THE PRIME OBJECTIVES OF EXPANDED USE, HIGH DRILLING RATES AND LOW COST |

What is claimed is:

1. Apparatus to permit the reinforcement of masonry structures, comprising:

a concentric double piped drill column for drilling a hole in a masonry structure to be reinforced so as to enable the hole to be filled with a reinforcement, said concentric double piped drill column having an inner pipe and an outer pipe surrounding and spaced from said inner pipe to create an annulus therebetween;

a drill bit assembly attached to said concentric double piped drill column;

a motor coupled to said concentric double piped drill column for causing each of the inner and outer pipes thereof to be rotated and the hole to be drilled in the masonry structure such that solid masonry core material is collected within said inner pipe;

an air compressor connected to force a supply of air under pressure downwardly through the annulus between the inner and outer pipes of said concentric double piped drill column and around said drill bit assembly so that said drill bit assembly is cooled and the drilling dust generated by said drill bit assembly is entrained within said air supply; and means for suctioning the entrained drilling dust away from the drill bit assembly by way of an exhaust passage established between the outer pipe of said concentric double piped drill column and the masonry structure through which the hole is drilled.

2. The apparatus recited in claim 1, wherein said means for suctioning the drilling dust includes a vacuum air plenum surrounding said concentric double piped drill column and communicating with said exhaust passage.

3. The apparatus recited in claim 2, wherein said vacuum air plenum is mounted against the masonry structure to be reinforced in airtight surrounding engagement with the outer pipe of said concentric double piped drill column to prevent the loss of suction within said exhaust passage.

4. The apparatus recited in claim 2, further comprising a dust collection bin communicating with said vacuum air plenum to collect the drilling dust being suctioned away from said drill bit assembly to said vacuum air plenum by way of said exhaust passage.

5. The apparatus recited in claim 1, further comprising means by which to inject a liquid or foam into the supply of air under pressure generated by said air compressor so as to cool the drill bit assembly by way of said annulus between the inner and outer pipes of said concentric double piped drill column.

6. The apparatus recited in claim 1, further comprising a valve communicating with the annulus between the inner and outer pipes of said concentric double piped drill column by which dirt clogs are removed therefrom.

7. The apparatus recited in claim 1, wherein said drill bit assembly is a wide kerf cutting bit assembly connected to adjacent ends of each of the inner and outer pipes of said concentric double piped drill column.

8. The apparatus recited in claim 1, wherein said drill bit assembly includes a first narrow kerf cutting bit connected to the outer pipe of said concentric double piped drill column and a second narrow kerf cutting bit connected to said inner pipe above the connection of said first narrow kerf cutting bit to said outer pipe.

9. The apparatus recited in claim 1, wherein each of the inner and outer pipes of said concentric double piped drill column is manufactured from a composite fiber reinforced material.

10. The apparatus recited in claim 1, further comprising a core catcher attached to the inner pipe of the said concentric double piped drill column above said drill bit assembly to engage the solid masonry core material that is collected within said inner pipe, such that the masonry core material is removed from the hole at the same time that said concentric double piped drill column is removed.

11. The apparatus recited in claim 1, wherein said motor is mounted on a drill stand that is located above the masonry structure to be reinforced, said air compressor communicating with said motor such that the supply of air under pressure is forced through said motor and into the annulus between the inner and outer pipes of said concentric double piped drill column.

12. The apparatus recited in claim 1, wherein the inner and outer pipes of said concentric double piped drill column are coupled to one another so as to be rotated together by said motor.

13. Pulverizing apparatus to permit the reinforcement of masonry structures, comprising:

a double piped drill column for drilling a hole in a masonry structure to be reinforced so as to enable the hole to be filled with a reinforcement, said double piped drill column having an inner pipe and an outer pipe surrounding and spaced from said inner pipe to create an annulus therebetween;

a core cutting bit connected to the outer pipe of the double piped drill column and a grinding bit connected to the inner pipe, said outer pipe having a series of air channels extending therethrough;

a motor coupled to said double piped drill column for causing each of the inner and outer pipes thereof to be rotated, whereby the hole will be drilled in the masonry structure by the core cutting bit of said outer pipe and the core that is cut out from the hole will be pulverized to debris by the grinding bit of said inner pipe;

an air compressor coupled to said double piped drill column to force a supply of air under pressure down said inner pipe and past said grinding bit thereof so that the pulverized core debris is entrained within the air supply; and means for suctioning the pulverized core debris away from the core cutting bit by way of each of an exhaust passage established between the outer pipe of said double piped drill column and the masonry structure through which the hole is drilled, the series of air channels extending through said outer pipe, and the annulus created between said inner and outer pipes.

14. The pulverizing apparatus recite in claim 13, wherein said grinding bit connected to the inner pipe of said double piped drill column is spaced upwardly from the core cutting bit connected to said outer pipe so that the core that is cut by said core cutting bit will be pulverized to debris by said grinding bit.

15. The pulverizing apparatus recited in claim 13, wherein said grinding bit is connected to a relatively wide, bell-shaped end of the inner pipe of said double piped drill column that lies in engagement with the outer pipe thereof.

16. The pulverizing apparatus recited in claim 13, further comprising a ring surrounding the outer pipe of said double piped drill column so as to block said exhaust passage and thereby force the pulverized core debris which is being suctioned by way of said exhaust passage through the series of air channels in said outer pipe and into said annulus between said inner and outer pipes.

17. The pulverizing apparatus recited in claim 13, wherein said means for suctioning the pulverized core debris includes a vacuum air plenum surrounding said double piped drill column and communicating with the annulus between said inner and outer pipe thereof.

18. The pulverizing apparatus recited in claim 17, further comprising a dust collection bin communicating with said vacuum air plenum to collect the pulverized core debris being suctioned through said exhaust passage, the series of air channels through said outer pipe, and said annulus between said inner and outer pipes.

19. The pulverizing apparatus recited in claim 13, wherein the inner and outer pipes of said concentric double piped drill column are coupled to one another so as to be rotated together by said motor.

20. A method to permit the reinforcement of masonry structures, said method comprising the steps of:

rotating a concentric double piped drill column for drilling a hole in a masonry structure to be reinforced so as to enable the hole to be filled with a reinforcement, said concentric double piped drill column having a rotatable inner pipe and a rotatable outer pipe surrounding and spaced from said inner pipe to create an annulus therebetween;

mounting a drill bit assembly on said concentric double piped drill column for drilling the hole in the masonry structure as said concentric double piped drill column is rotated;

forcing a supply of air under pressure downwardly through the annulus between the inner and outer pipes of said concentric double piped drill column and around said drill bit assembly so that said drill bit assembly is cooled and the drilling dust generated by said drill bit assembly is entrained within said air supply;

suctioning the entrained drilling dust away from the drill bit assembly by way of an exhaust passage established between the outer pipe of said concentric double piped drill column and the masonry structure through which the hole is drilled;

removing said concentric double piped drill column from the hole drilled in the masonry structure; and loading the hole with said reinforcement including at least one reinforcing bar and filling said hole with grout, said grout containing a mixture of sand and an adhesive for surrounding said reinforcement bar.

21. The method recited in claim 20, wherein said adhesive to be mixed with sand to form said grout to surround said reinforcement bar is a resin characterized by a maximum viscosity lying in a range between 150–300 Cps, a maximum tensile strength lying in a range between 9,000–10,000 psi, a maximum heat distortion temperature of 185 degrees Fahrenheit, a flexural modulus lying in a range between 450,000–470,000 psi and a flexural strength lying in range of 17,000–18,000 psi.

* * * * *